US009506707B2

(12) United States Patent
Nakayama et al.

(10) Patent No.: US 9,506,707 B2
(45) **Date of Patent: *Nov. 29, 2016**

(54) WEAPON MAGAZINE

(71) Applicant: Magpul Industries Corp., Louisville, CO (US)

(72) Inventors: Brian L. Nakayama, Arvada, CO (US); Jeremy Fiester, Lafayette, CO (US); Nicholas Kielsmeier, Denver, CO (US); Michael T. Mayberry, Denver, CO (US)

(73) Assignee: MAGPUL INDUSTRIES CORP., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/170,658

(22) Filed: Jun. 1, 2016

(65) Prior Publication Data

US 2016/0273858 A1 Sep. 22, 2016

Related U.S. Application Data

(63) Continuation of application No. 14/523,634, filed on Oct. 24, 2014, now Pat. No. 9,383,152.

(51) Int. Cl.
*F41A 9/70* (2006.01)
*F41A 9/65* (2006.01)

(52) U.S. Cl.
CPC ... *F41A 9/70* (2013.01); *F41A 9/65* (2013.01)

(58) Field of Classification Search
CPC ..... F41A 9/65; F41A 9/69; F41A 9/70; F41A 9/71; F41A 9/67
USPC ..... 42/11, 17, 21, 24, 29, 33, 35, 37, 39, 42/6–7, 49.01–49.02, 50; 89/195–197, 89/33.1, 33.01
See application file for complete search history.

(56) References Cited

U.S. PATENT DOCUMENTS 1,245,499 A * 11/1917 Orme ..... F41A 9/67 124/52
1,719,384 A 7/1929 Tansley
(Continued)

FOREIGN PATENT DOCUMENTS

WO 0206749 A1 1/2002
WO 2005075929 A3 3/2006
(Continued)

OTHER PUBLICATIONS

Cooper, John, "Office Action re U.S. Appl. No. 14/523,634", Nov. 16, 2015, p. 39, Published in: US.
(Continued)

*Primary Examiner* — John D Cooper
(74) *Attorney, Agent, or Firm* — Neugeboren O'Dowd PC

(57) ABSTRACT

A system and method for using a firearm magazine are described. One example includes a firearm magazine assembly. The assembly has a housing defining a cartridge track, the housing having a distal end having feed lips for feeding cartridges to a firearm and a proximal end. The assembly also has a follower assembly having a follower and a spring. The follower has aproximal side and a distal side and is movable between a compressed position and an extended position. The follower further has at least two angled surfaces to engage the housing and bias the feed lips towards each other when the follower is in the extended position.

21 Claims, 13 Drawing Sheets

(56) References Cited

U.S. PATENT DOCUMENTS

| | | | | |
|---|---|---|---|---|
| 4,107,862 | A | 8/1978 | Sofinowski, III | |
| 4,539,889 | A | 9/1985 | Glock | |
| 4,766,800 | A | 8/1988 | Miller et al. | |
| 4,798,018 | A | 1/1989 | Johansson | |
| 4,862,618 | A | 9/1989 | Szabo | |
| 4,888,898 | A | 12/1989 | Miller et al. | |
| 5,168,648 | A | 12/1992 | Brandl et al. | |
| 5,357,703 | A | 10/1994 | Chesnut et al. | |
| 5,438,783 | A | 8/1995 | Sniezak et al. | |
| D362,044 | S | 9/1995 | Sniezak | |
| 5,461,811 | A | 10/1995 | Ciener | |
| 5,495,687 | A | 3/1996 | Waiser | |
| 5,615,505 | A | 4/1997 | Vaid | |
| 5,651,204 | A | 7/1997 | Hulsey et al. | |
| 5,755,052 | A * | 5/1998 | Keeney | F41A 9/65 42/50 |
| D401,992 | S | 12/1998 | Pearce | |
| 5,845,426 | A | 12/1998 | Valorose | |
| 6,055,758 | A | 5/2000 | Vieweg | |
| 7,069,683 | B1 | 7/2006 | Kapusta | |
| 7,093,386 | B1 | 8/2006 | Vieweg | |
| 7,200,963 | B1 | 4/2007 | Vieweg | |
| 7,200,964 | B2 | 4/2007 | Gates | |
| 7,237,354 | B1 | 7/2007 | Conner | |
| 7,318,294 | B2 | 1/2008 | Zimmermann | |
| 7,779,571 | B1 | 8/2010 | Roth | |
| 7,797,871 | B2 | 9/2010 | Bubits | |
| 7,908,780 | B2 * | 3/2011 | Fitzpatrick | F41A 9/65 42/50 |
| 8,006,423 | B1 * | 8/2011 | Alzamora | F41A 9/65 42/49.01 |
| 8,042,297 | B2 | 10/2011 | Emde | |
| 8,561,334 | B2 | 10/2013 | Metzger | |
| 8,607,489 | B1 | 12/2013 | Calvert | |
| 8,646,200 | B2 | 2/2014 | Rendulic | |
| 8,671,606 | B2 | 3/2014 | Plataniotis et al. | |
| 8,752,318 | B2 | 6/2014 | Pulit, Jr. | |
| 2001/0037596 | A1 * | 11/2001 | Salvitti | F41A 17/64 42/70.08 |
| 2004/0148838 | A1 | 8/2004 | Conner | |
| 2004/0154207 | A1 | 8/2004 | Conner | |
| 2008/0028661 | A1 | 2/2008 | Bubits | |
| 2008/0196290 | A1 | 8/2008 | Bubits et al. | |
| 2010/0251590 | A1 * | 10/2010 | Fitzpatrick | F41A 9/65 42/50 |
| 2010/0299986 | A1 | 12/2010 | Emde | |
| 2011/0030259 | A1 * | 2/2011 | Castro | F41A 9/67 42/6 |
| 2012/0227300 | A1 | 9/2012 | Seeley et al. | |
| 2013/0019511 | A1 | 1/2013 | Plataniotis et al. | |
| 2013/0180146 | A1 * | 7/2013 | Fitzpatrick | F41A 9/70 42/50 |
| 2013/0227870 | A1 | 9/2013 | Rendulic | |
| 2014/0075810 | A1 * | 3/2014 | Mikroulis | F41A 17/36 42/50 |
| 2015/0292826 | A1 * | 10/2015 | Kielsmeier | F41A 9/70 42/50 |
| 2016/0025436 | A1 * | 1/2016 | Higley | F41A 9/70 42/49.01 |

FOREIGN PATENT DOCUMENTS

| | | | |
|---|---|---|---|
| WO | 2009000973 | A3 | 4/2009 |
| WO | 2012073052 | A1 | 6/2012 |
| WO | 2013086416 | A1 | 6/2013 |

OTHER PUBLICATIONS

Schneider, Laura A., "Response to Office Action re U.S. Appl. No. 14/523,634", Feb. 17, 2016, p. 10, Published in: US.

Glock Perfection, "Glock 17", p. 4, Publisher: Webpage located at http://us.glock.com/products/model/g17 downloaded on Jan. 29, 2015, Published in: US.

Glockstore Performance Center, "Glock Factory Magazines", "webpage found at http://www.glockstore.com/glock-factory-magazines/standard-glock-factory-magazines downloaded on Jan. 29, 2015", Published in: US.

Glockstore Performance Center, "Glock Mag Follower 9mm New Style", "webpage found at http://www.glockstore.com/mag-parts-extensions/glock-mag-follower-9mm-new-style-new-version-6 downloaded on Jan. 29, 2015", Published in: US.

Glockstore Performance Center, "Glock Factory Magazine 4 Packs", "webpage found at http://www.glockstore.com/glock-factory-magazines/glock-factory-magazine-4-packs downloaded on Jan. 29, 2015", p. 2, Published in: US.

Glockstore Performance Center, "Glock Mag Floor Plate 9/40/.357/.45GAP", "webpage found at http://www.glockstore.com/mag-parts-extensions/glock-mag-floor-plate-9-40-357-45gap downloaded on Jan. 29, 2015", p. 2, Published in: US.

KCI Mags, "KCI Glock 17-9mm 17 Round Magazine", "webpage found at http://www.kcimags.com/kci-glock-17-9mm-17-round-magazine/ downloaded on Jan. 29, 2015", p. 2, Published in: US.

Liberty Tree, "Breaking Down Ruger's New Polymer", Nov. 8, 2011, p. 22, Published in: US.

Promag, "GLK-A8—Glock 17/19/26 9mm (32)RD Black Polymer Magazine", "webpage found at https://promagindustries.com/glock/149-glock-17-19-26-9mm-32rd-black-polymer-magazine.html downloaded on Jan. 29, 2015", p. 5, Published in: US.

Nguyen, John, "International Search Report and Written Opinion re Application No. PCTUS1556975", Dec. 3, 2015, p. 12, Published in: WO.

Beaufume, C. European Search Report for European Patent Application No. 15851857.1, Oct. 17, 2016, 9 pages.

* cited by examiner

WEAPON MAGAZINE

CROSS-REFERENCE TO RELATED APPLICATIONS

This application is a Continuation of U.S. application Ser. No. 14/523,634 filed on Oct. 24, 2014 and entitled "WEAPON MAGAZINE," the entire disclosure of which is hereby incorporated by reference for all proper purposes.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates to firearms. In particular, but not by way of limitation, the present invention relates to systems and methods for firearm magazines.

BACKGROUND OF THE INVENTION

Firearms, such as pistols, are generally used with a magazine assembly to feed cartridges to the weapon. The magazines generally have a housing to contain and guide the cartridges, and a follower assembly having a spring to maintain loaded cartridges biased towards an exit of the magazine. Opposing the exit is generally a removable floorplate, to allow disassembly of the magazine for repair or cleaning.

In the past, magazines were generally made of metal. However, attempts to use polymeric housings have led to undesirable performance of the magazines.

One non-limiting example of the problems associated with polymeric housings involves the properties of the polymer itself. Specifically, polymeric materials exhibit creep at room temperature or human-survivable weather temperatures, where the magazine will usually be stored. Creep in polymeric firearm magazines is particularly exacerbated at the feed lips of the magazines, because the feed lips are under constant stress from the follower, spring assembly, and cartridges pressing against the feed lips. Even when the magazine is unloaded and in storage, the feed lips experience a constant stress. This constant stress causes the gap between the feed lips in a polymeric magazine to widen over time, resulting in a magazine that does not properly constrain the cartridges and/or feed reliably, if at all.

To overcome this known problem, past solutions have involved using a metallic lining or fully metallic housing or feed lips to minimize the effects of creep. However, it remains desirable to provide a magazine assembly without any of these metallic portions while still maintaining or even improving reliability.

In another non-limiting example, currently-available firearm magazines often require a special-purpose tool for disassembly. The special-purpose tool is easily lost or otherwise not available to the user when needed.

In still another non-limiting example, the spring in currently available firearm magazines may be over-compressed if the magazine is loaded beyond the stated capacity, leading to exacerbated loss of the spring constant and/or the spring folding over itself, requiring disassembly of the magazine, which is in itself problematic as described above. Spring over-compression is a relatively common problem, and difficult to overcome, because the springs must be designed to fit the interior of the magazine housing, a less-than-optimal spring shape, and apply a spring force in a narrow desired range to maintain optimal feeding of the cartridges.

In still another non-limiting example, the use of polymeric housings has been problematic because the polymeric housing is preferably manufactured with a sufficient interference between the housing and firearm to maintain engagement. Yet, this interference also may interfere with movement of the trigger bar on the weapon and/or prevent the magazine from dropping properly.

In still another non-limiting example, when loading currently-available magazines by hand, the user must manually align a rim of a cartridge being loaded with a case of a previously-loaded cartridge, and apply significant force to the cartridge being loaded in a generally downward direction (e.g., into the magazine), to overcome the follower spring force and insert the new cartridge. That is, the user must effectively push two cylinders together (the cartridge casings), or, put another way, constrain three-dimensional positioning and motion of the cartridge while attempting to apply a concentrated force in the direction of travel of the cartridge. Because of this, the user is prone to causing the cartridge being loaded to slip off, leading to loss of cartridges and/or increased loading times.

Although present devices and methods are functional, they are not sufficiently efficient or otherwise satisfactory. Accordingly, a system and method are needed to address some of the shortfalls of present technology and to provide other new and innovative features.

SUMMARY OF THE INVENTION

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

The present invention can provide a system and method for using a firearm magazine assembly. One example includes a firearm magazine assembly. The assembly has a housing defining a cartridge track, the housing having a distal end having feed lips for feeding cartridges to a firearm and a proximal end. The assembly also has a follower assembly having a follower and a spring. The follower has aproximal side and a distal side and is movable between a compressed position and an extended position. The follower further has at least two angled surfaces to engage the housing and bias the feed lips towards each other when the follower is in the extended position.

Another example includes a method of using a firearm magazine assembly. The method includes causing a follower to engage a housing when the follower is in an extended position, and causing the follower to bias the feed lips of the housing towards each other when the follower is in the extended position.

As previously stated, the above-described examples and implementations are for illustration purposes only. Numerous other embodiments, examples, implementations, and details of the invention are easily recognized by those of skill in the art from the following descriptions and claims.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Throughout this document, particular reference will be made to various features and relationships between the features of a magazine assembly 100. It should be understood that defining these features means defining within manufacturing tolerances and equivalents. As an example, the terms "parallel and perpendicular" shall be understood to mean within a reasonable manufacturing tolerance approaching parallel or perpendicular, respectively, as defined by the industry. As another example, the term "curve" should be understood to mean one or more curves or lines connected to arrive at a non-linear shape. As another example, the terms "about, substantial, and approximately" and the like shall be understood to mean within a reasonable manufacturing tolerance as defined by the industry.

Figure 1:
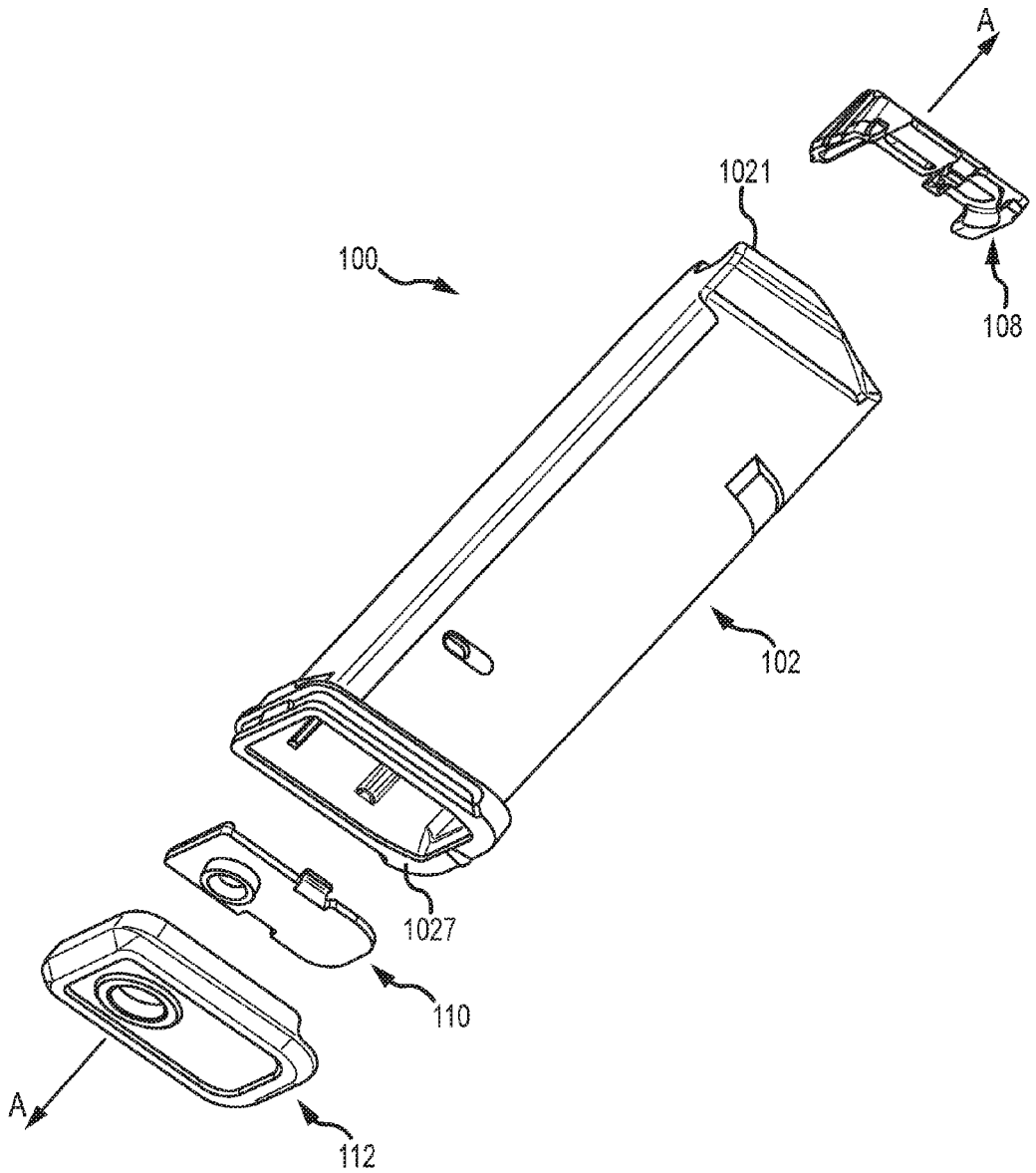
FIG. 1 illustrates an exploded isometric view of a magazine assembly according to some embodiments.

Referring now to the drawings, where like or similar elements are designated with identical reference numerals throughout the several views, and referring in particular to FIG. 1, it illustrates an exploded view of a firearm magazine assembly 100 according to an embodiment. The assembly 100 includes a housing 102 and a follower assembly having a follower 108, a spring (not shown), and an insert 110.

The housing 102 is a polymer housing 102 defining a cartridge track for guiding cartridges towards a distal end 1021 of the housing 102. For the purpose of this application, the distal end 1021 shall be that end associated with the feed end of the housing 102. The distal end 1021 has a pair of feed lips for feeding cartridges to a firearm. The housing 102 also has a proximal end 1027 substantially opposing the distal end 1021. Ridges 1024 (see FIG. 3A) on the interior of the housing 102 may be provided to reduce friction between the cartridges and the interior of the housing 102 as the cartridges are moved through the housing 102.

Continuing with FIG. 1, the follower assembly has a compressed configuration associated with a fully loaded magazine assembly 100, and an extended configuration associated with an empty magazine assembly 100. In some embodiments, the magazine assembly 100 is configured to feed 9 mm cartridges to a weapon, such as 9 mm Parabellum or 9 mm Luger cartridges, and the assembly 100 may be configured for use with a Glock style pistol, such as the Glock 17, 18, 19, 26, or 34.

Figure 3A:
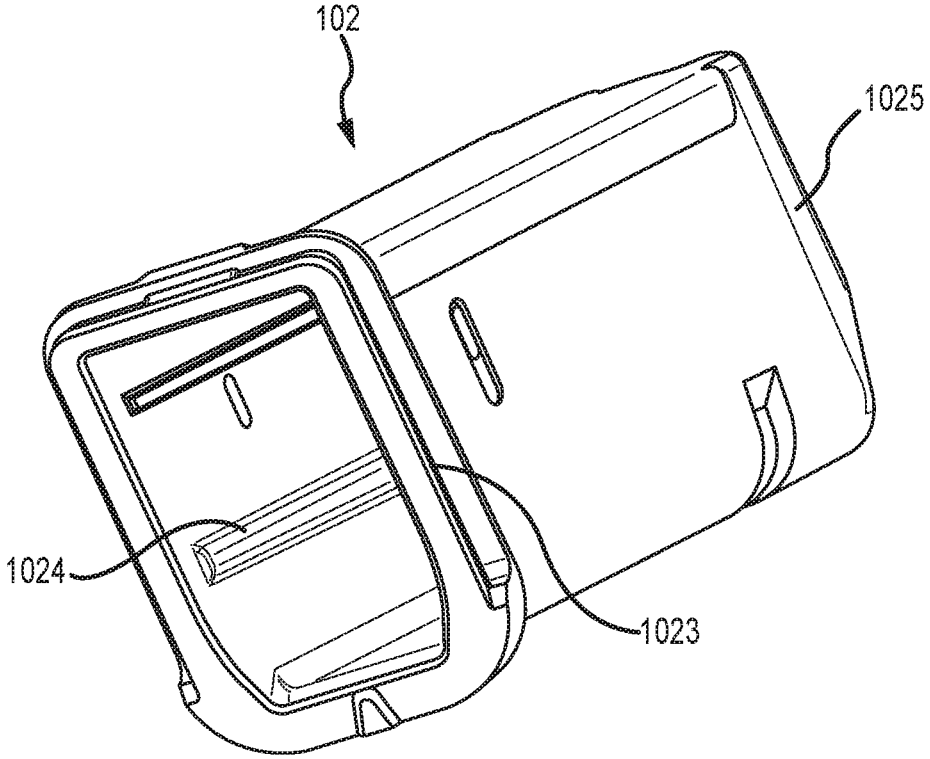
FIGS. 3A-3E illustrate isometric, rear section, front section, front, and top views, respectively, of a housing according to some embodiments.

As seen in a brief reference to FIG. 3A, a floorplate 112 may be mounted to the housing 102 at a floorplate mount 1023, which may include mounting ribs for receiving the floorplate 112. In some embodiments, engagement between the housing 102 and the floorplate 112 may be a slidable engagement, as shown, or engagement may be achieved via any other suitable means, such as, without limitation, screwing, bolting, hinging, and clamping the floorplate 112 to the housing 102. As previously mentioned, the floorplate 112 is removably engaged with the proximal end 1027 of the housing 102. However, the floorplate 112 is also removably engaged with the insert 110, to maintain the insert 110 and, in turn, a proximal portion of the spring fixed near the proximal end 1027 of the housing 102.

Figure 2A:
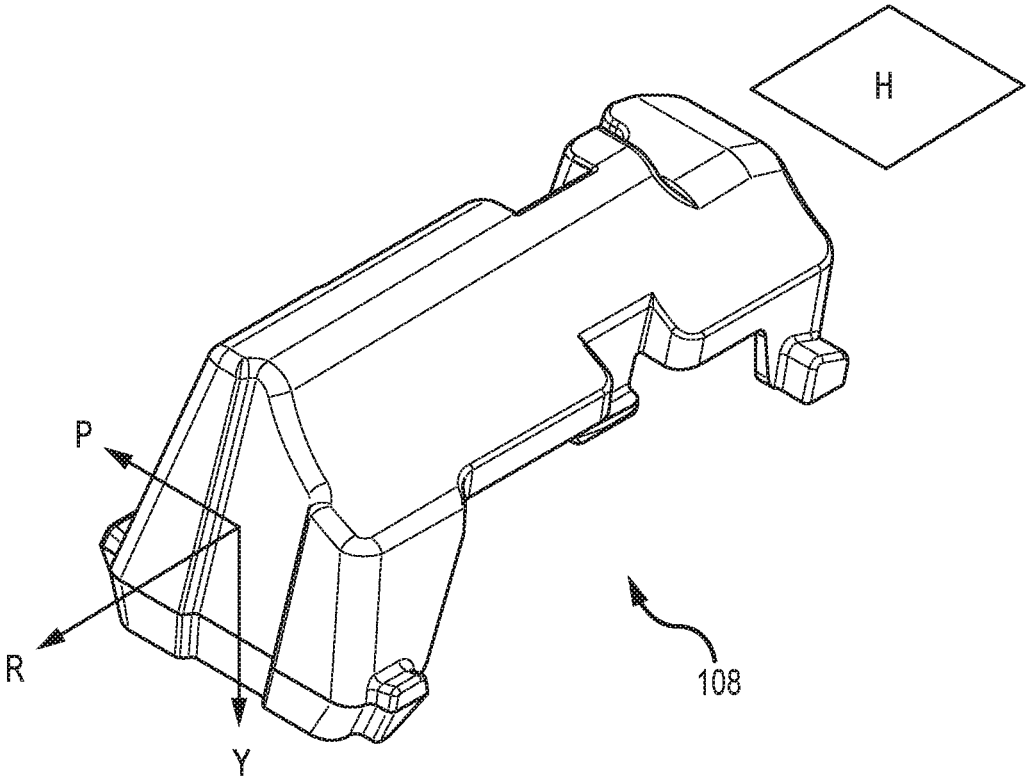
FIGS. 2A-2F illustrate isometric, top, right, left, and detail views, respectively, of a follower according to some embodiments.
Figure 2B:
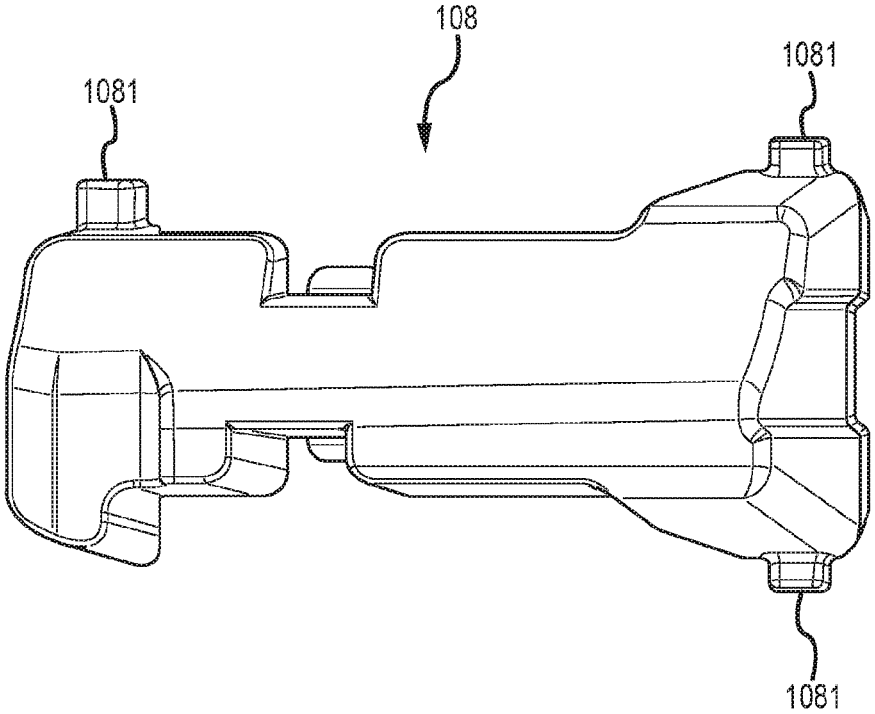
Figure 2C:
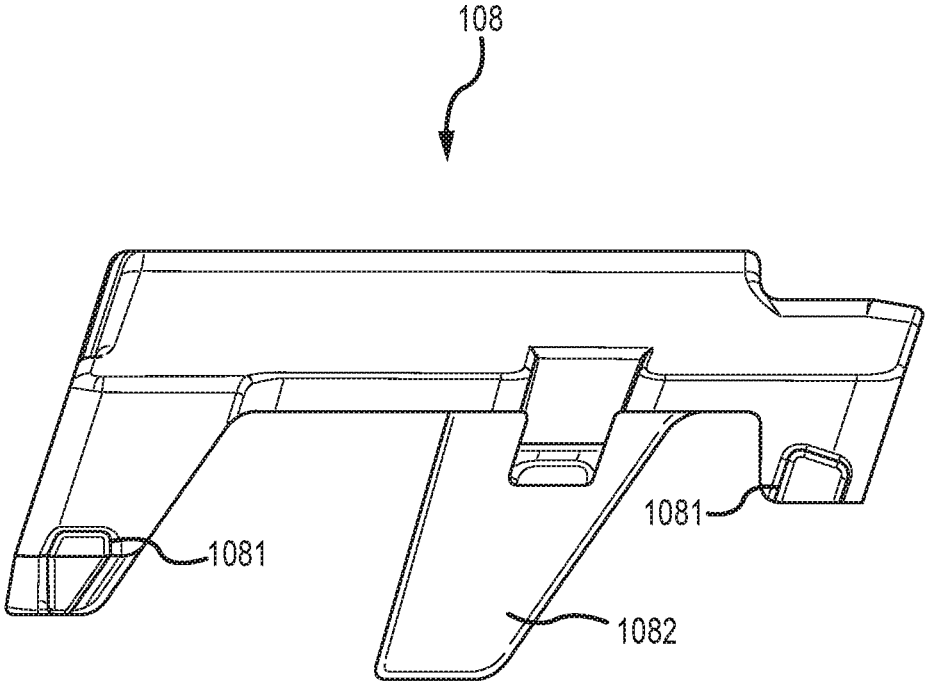
Figure 2D:
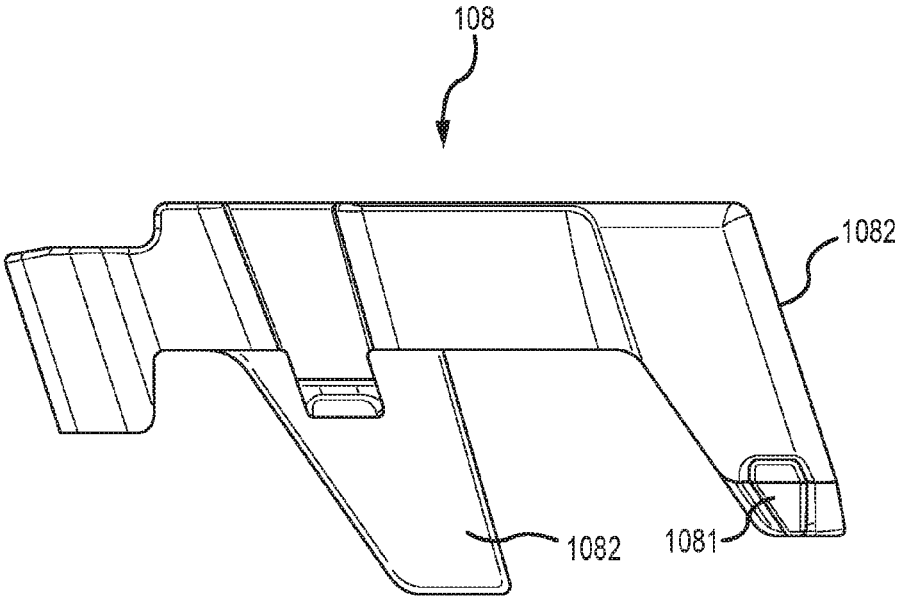

Turning now to FIGS. 2A-2F, the follower assembly also has an extension limiter 1081 (see FIG. 2B) and a compression limiter 1082 (see FIG. 2C). The compression limiter 1082 prevents the spring from over-compression, while the extension limiter 1081 prevents the spring from forcing the follower 108 against the feed lips when the magazine is empty. The compression limiter 1082 may be one or more protrusions extending from the proximal side of the follower 108, for abutting the insert 110 to prevent over-compression of the spring. Although depicted as a protrusion on the follower 108, it should be understood that, in some embodiments, the compression limiter 1082 may be one or more protrusions extending from the distal side of the insert 110, for abutting the follower 108 to prevent over-compression of the spring. It should also be understood that some combination of protrusions on the insert 110 and the follower 108 may engage with one another or other corresponding engagement features to prevent over-compression of the spring.

Continuing with FIGS. 2A-2F, the extension limiter 1081 is now discussed in further detail. As previously described, the extension limiter 1081 is configured to prevent the follower 108 from being forced against the feed lips when the magazine 100 is empty. The extension limiter 1081 described herein protects the feed lips from the effects of creep by ensuring the follower 108 does not apply a force on the feed lips when the magazine 100 is empty. In some embodiments, the extension limiter 1081 may be a plurality of tabs, seen clearly in FIG. 2B, in the follower 108 for engaging one or more shelves in the housing 102, to prevent the spring from forcing the follower against the feed lips. That is, the follower 108 stops its travel toward the distal end 1021 of the housing 102 before contacting the feed lips or before applying any force to the feed lips.

A plurality of tabs (e.g., three tabs) in the follower 108, as shown in FIGS. 2A-2F, may also provide for further guidance of the follower 108 as it travels through the magazine; however, it should be understood that in an alternative, tabs in the housing 102 may engage one or more shelves in the follower 108 to prevent the spring from forcing the follower against the feed lips. The extension limiter 1081 may be three tabs in the follower 108 for engaging one or more shelves 1026 (see FIGS. 3B-3C) in the housing 102 to prevent the spring from forcing the follower 108 against the feed lips. Three tabs may be desirable because the three points define a plane which can be aligned with the housing 102. In some instances, three tabs may be preferred over four tabs, since a fourth tab may deviate from a plane defined by three tabs, thus requiring greater manufacturing precision. In some embodiments, the shelf or shelves 1026 in the housing 102 may provide for an increased recess for catching debris displaced towards the distal end 1021 of the magazine assembly 100 while feeding cartridges to a weapon. In some embodiments, one or more of the tabs 1026 can be elongated and stretch along a side of the follower 108, in some cases extending along a majority or an entirety of a side of the follower 108.

Figure 2E:
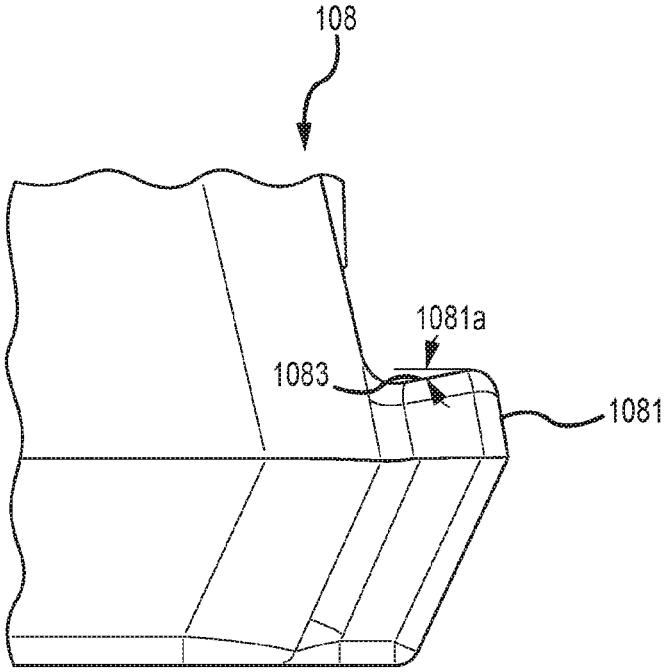

Turning now to FIG. 2E, shown is a rear detail view of a portion of the extension limiter 1081. Specifically, FIG. 2E illustrates a rear view of the follower 108 showing a tab at an edge of the follower 108. The tab is configured to abut a shelf 1026 in the interior portion of the housing 102 to prevent the follower 108 from abutting the feed lips of the housing 102.

Continuing with FIG. 2E, the extension limiter 1081 may be configured to bias the housing 102 towards the follower 108 when the follower assembly is in the extended configuration. Specifically, the extension limiter 1081 may include at least two opposing tabs having an angled shelf abutment 1083 configured to bias the housing 102 towards the follower 108 by engaging one or more shelves 1026 in the housing 102 at an angle 1081*a*. As the follower 108 is pushed towards the distal end of the housing 102 by the spring, the angled shelf abutment 1083 transforms some of the spring exit force into a transverse force, thus causing the distal portion of the housing 102 to be pulled in slightly (e.g., causing the feed lips to be pulled together). This slight inward pull further improves the performance of the magazine assembly 100 by preventing the polymer housing 102 and polymer feed lips from developing a permanently widened gap over time.

It should be noted here that the angled shelf abutments 1083 are angled relative to a horizontal of the follower 108, defined as horizontal H in FIG. 2A; that is, the angled shelf abutments 1083 are neither parallel nor perpendicular to the horizontal H of the follower. In some embodiments, the angled shelf abutment(s) 1083 may comprise a shelf or abutting feature defined by a plane that crosses the pitch axis P at a single point, the roll axis R at a single point, and the yaw axis Y at a single point. The angled shelf abutment(s) 1083 may serve to pull the distal end 1021 of the housing 102 in towards the follower 108 and/or provide a stop feature for the follower 108.

Figure 2F:
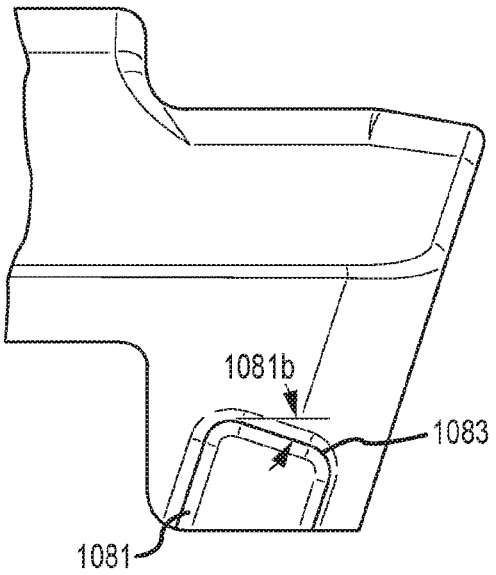

The stop feature may be an angled shelf abutment 1083 as depicted in FIG. 2F, which has a surface that is at an angle 1081*b* relative to the follower horizontal H, but is perpendicular to the direction of travel A (see FIG. 1) within the housing 102.

In some embodiments, one or more angled shelf abutments 1083 may be at an angle 1081*a* relative to the roll axis R (see FIGS. 2A, 2E) and the horizontal H of the follower 108. That is, in some embodiments, one or more of the angled shelf abutments 1083 may include a shelf parallel to a plane that crosses a single point on the pitch axis P of the follower 108 and two points on the roll axis R of the follower 108.

Referencing now FIGS. 2A and 2F, shown is an embodiment of an angled shelf abutment at an angle 1081*b* relative to the follower horizontal H that provides a stop feature at the nose of the follower 108. In some embodiments, at least one of the angled shelf abutments 1083 may be at an angle 1081*b* relative to the pitch axis P and the horizontal H of the follower 108. That is, in some embodiments, the angled shelf abutment 1083 may be a shelf parallel to a plane crossing a single point on the roll axis R of the follower and two points on the pitch axis P of the follower. It should be understood that the one or more shelves 1026 in the housing 102 may have corresponding angles for engagement with the one or more angled shelf abutments 1083.

In some embodiments, due to a plurality of angled shelf abutments 1083 and corresponding angles 1026 in the housing 102, the follower 108 may pull the distal end 1021 including the feed lips of the housing 102 towards the follower 108 when the follower assembly is in the extended configuration. It should also be understood that, although shown as having relatively flat planes having an angle relative to the horizontal H, one or more angled shelf abutments 1083 could also have a curvature or protrusion, to name just two non-limiting examples, that interface with the one or more shelves 1026.

Figure 3B:
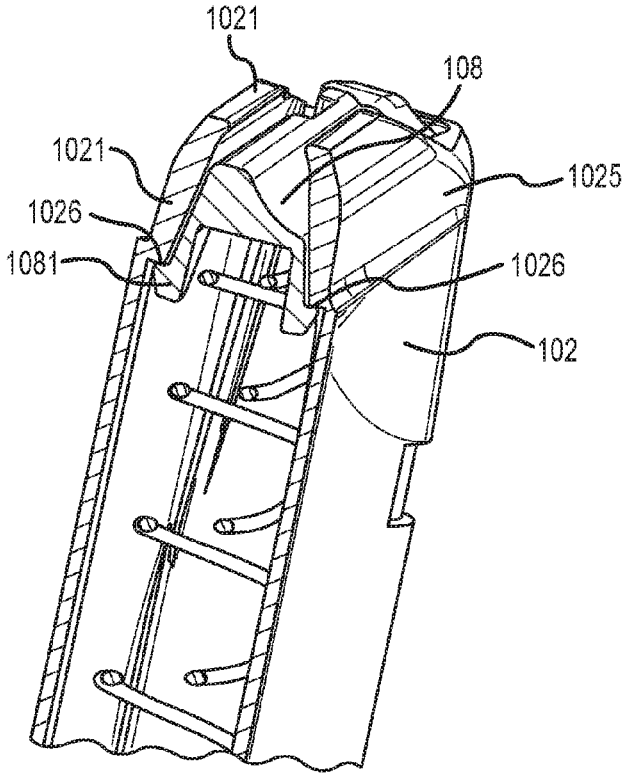
Figure 3C:
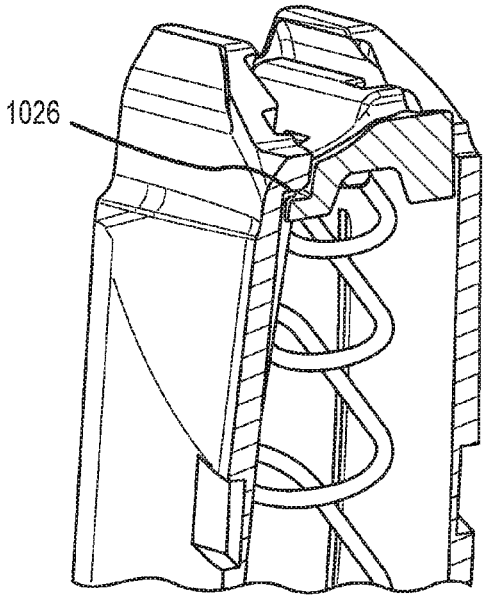
Figure 3D:
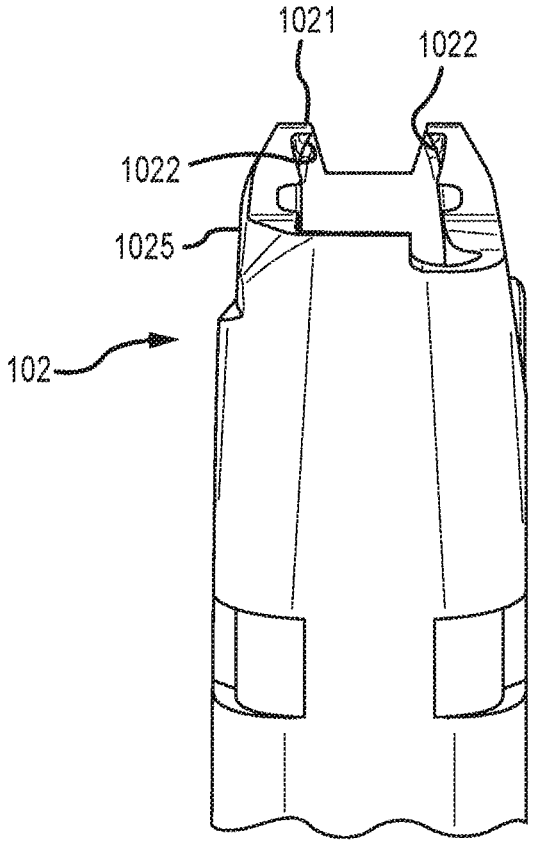

Turning now to FIGS. 3B and 3D, shown is a relief 1025, which may be provided on the exterior of the housing 102 to allow a trigger bar to pass when the magazine is in use with a weapon, as well as to improve dropping reliability of the magazine 100.

Figure 3E:
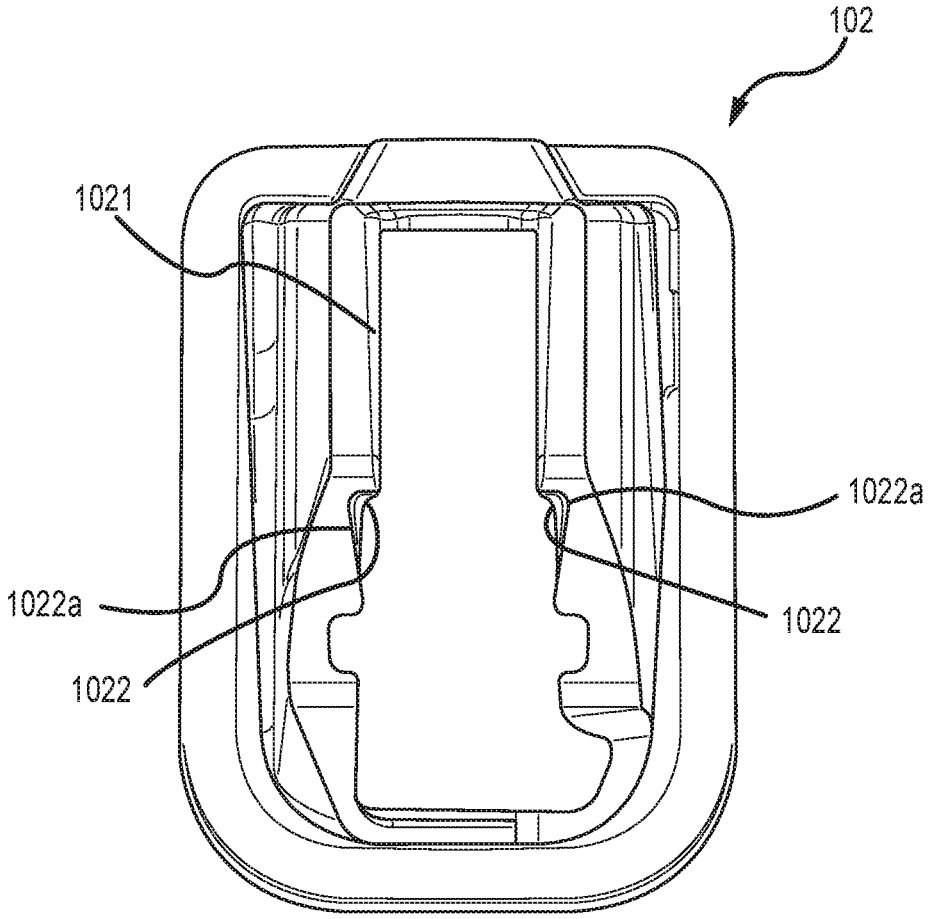

Continuing with FIGS. 3D-3E, a cartridge loading guide 1022, which is included in some embodiments of the assembly 100, is now discussed. The cartridge loading guide 1022 is configured to allow a rim of a cartridge being loaded to align with a case of a previously-loaded cartridge. Specifically, the cartridge loading guide 1022 provides a stop to the cartridge being loaded such that the lowest portion of the rim of the cartridge to be loaded abuts the highest portion of the case of a previously-loaded cartridge. The cartridge loading guide 1022 thus eliminates one degree of freedom for cartridges being loaded, overcoming the problem in previously-available magazines of the user having to align the cartridge to be loaded. In turn, the cartridge loading guide 1022 may reduce the time required for loading and the level of concentration required on the part of the user, who may be loading the magazine in the field, as well as reduce the chances of a user dropping a cartridge being loaded. As to this last point of reducing the chances of dropping a cartridge to be loaded, the cartridge loading guide 1022 prevents the cartridge being loaded from slipping off the previously loaded cartridge. Moreover, the loading force itself may be reduced, because the cartridge loading guide 1022 causes the loading force to be optimally aligned with the appropriate line of travel. In turn, the cartridge loading guide 1022 reduces the overall loading effort required by the user.

With specific reference to FIG. 3E, the cartridge loading guide 1022 may include a guide lead-in 1022*a*, where the guide lead-in can be wider than the cartridge loading guide 1022. The combination of the guide lead-in 1022*a* and the cartridge loading guide 1022 forming a somewhat tapered channel that may guide the rim of a cartridge that is being loaded into the magazine housing 102.

Figure 4A:
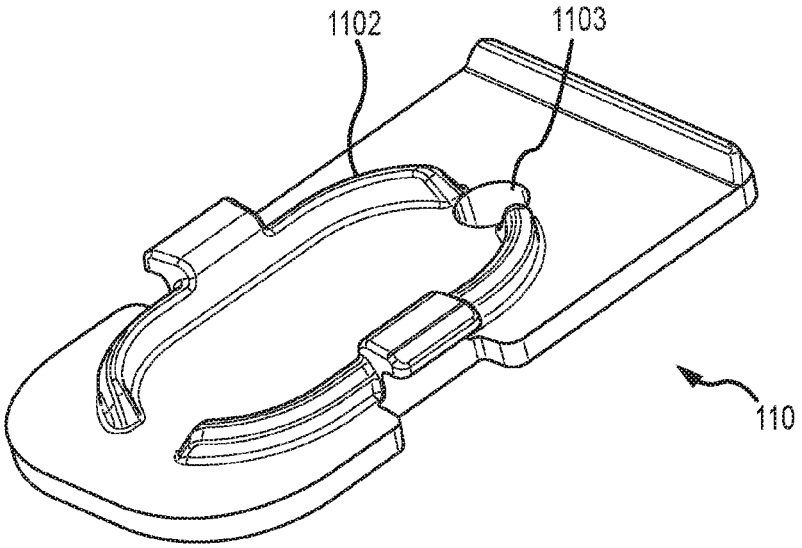
FIGS. 4A-4B illustrate isometric top and bottom views of an insert according to some embodiments.
Figure 4B:
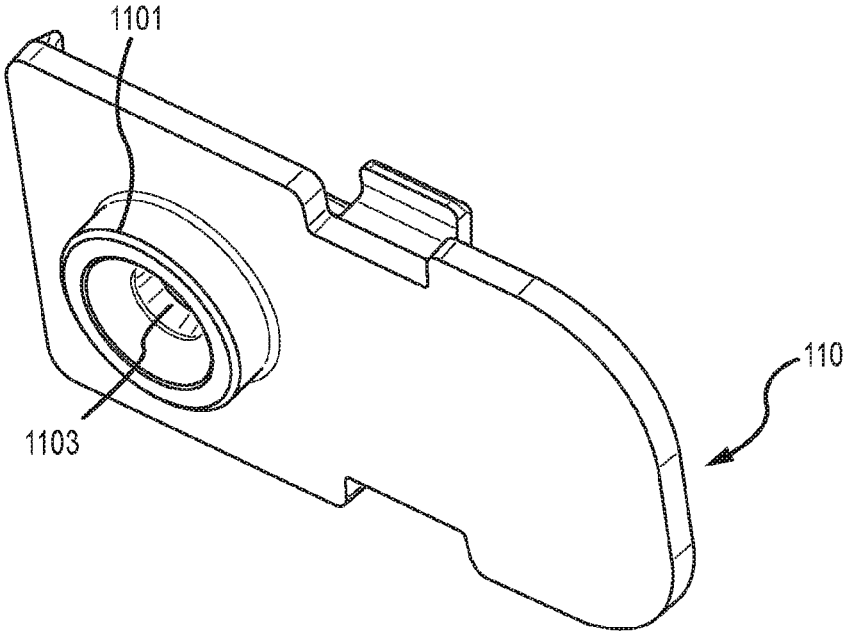
Figure 5A:
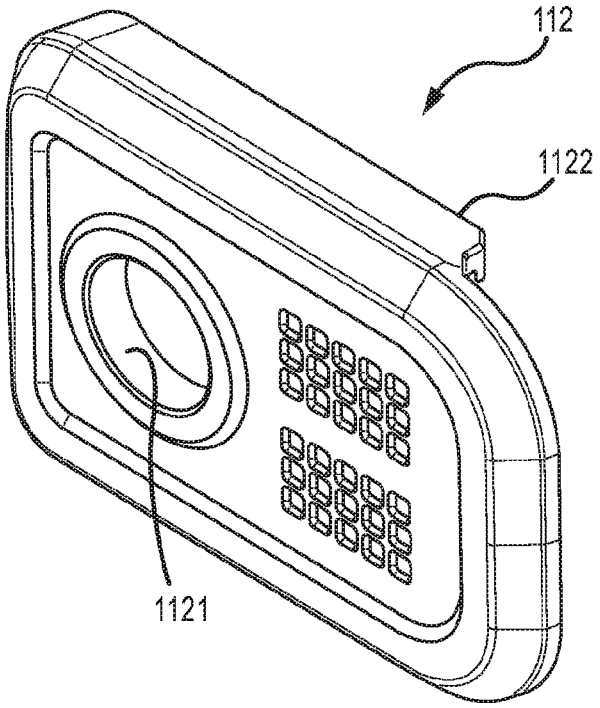
FIG. 5A illustrates a bottom isometric view of a floorplate according to some embodiments.
Figure 5B:
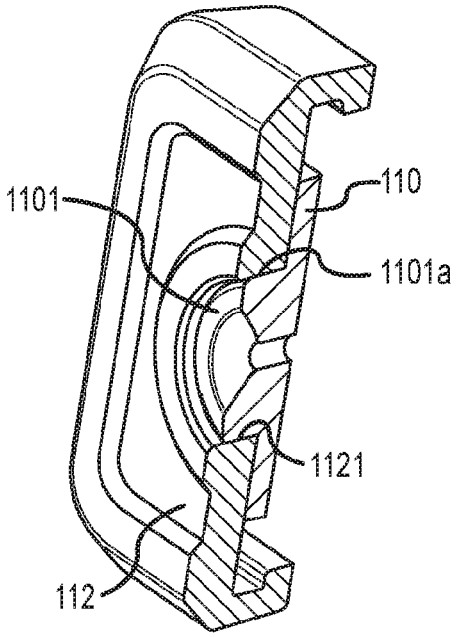
FIG. 5B illustrates a cross-section view of an insert assembled with an insert release according to some embodiments.

Referencing now FIGS. 4A and 4B, the insert 110 may include an insert release 1101 and a spring-insert mount 1102. As seen in FIGS. 5A and 5B, the floorplate 112 may include a release passage 1121 and a housing-floorplate mount 1122. The release passage 1121 may allow user access to the insert release 1101 to allow the user to disengage the insert 110 from the floorplate 112.

In prior magazines, the typical insert release and release passage required that the user carry a disassembly tool to disassemble the magazine. In those magazines, the release passage itself was conical with a small button at the bottom, or a convex button in a tubular release passage, so the release passage provided the guidance for the tool, which in turn required a tool that was no larger than the button. In the embodiment shown in FIGS. 4A-5B, in contrast, the insert release 1101 and the release passage 1121 are configured to enable disengagement of the insert 110 from the floorplate 112 using a cartridge (or any variety of sharp or blunt objects/tools), such as a 9 mm cartridge (e.g., a cartridge from the magazine), and a concave shape of the insert release 1101, as shown in FIG. 5B, may provide guidance for the cartridge. Providing for disengagement using the cartridge itself is an improvement over prior magazines, because a user is more likely to have a cartridge for the magazine on hand (or in the magazine) than to have a specialized tool on hand (which is also more likely to be lost and increases the complexity of a user's kit).

Embodiments providing for disengagement using a cartridge from the magazine (e.g., a 9 mm, 5.56 mm, .308 cal., or most pistol cartridges) overcome a particular problem. Specifically, these cartridges are typically designed with a relatively rounded, soft point bullet nose that presents a less optimal geometry for use as a removal tool, as compared to other common cartridges, such as the .22 LR, .40 cal., .45 cal., 32 ACP, etc. Therefore, and as seen in FIG. 5B, the insert release 1101 has a concave engagement surface relative to the floorplate 112, which enables disengagement using a 9 mm cartridge or other similarly blunt-nosed cartridge or improvised tool.

Referencing now FIG. 5B, a cross section of the insert 110 assembled with the floorplate 112 shows the interface between the release passage 1121 and the insert release 1101. When assembled, the insert release 1101 and the release passage 1121 can have an interference fit, with it being understood that the insert release 1101 is more flexible and/or resilient than the release passage 1121. In some embodiments, to release the insert 110 from the floorplate 112 using a blunt object such as a 9 mm cartridge, the user may insert an end of a cylindrical device having a rounded nose with a convex radius of curvature of at least about 3 mm into a lead-in portion 1101*a* of an insert release 1101 to apply enough pressure on the insert release 1101 that will cause the insert release 1101 to deform from an interference fit with the release passage. A continued force may be applied to cause the insert 110 to disengage completely from the floorplate 112. In some embodiments, the blunt end of the cylindrical device may be inserted at an angle relative to the line of travel, so as to extract the insert release 1101 from the release passage 1121. It should be understood that a rocking motion or other similar motion may be employed to disengage; therefore, a release passage 1121 having a diameter that is measurably larger than the intended release tool or 9 mm cartridge is preferred.

In some embodiments, to disengage the insert 110 from the floorplate 112, a user may use a tool or other object having a generally convex engagement surface, wherein the generally convex engagement surface is shaped and sized to fit into a ⅜" diameter cylinder. In some embodiments, a user may use an object having a generally conical shaped or tapered protrusion that is greater than 9 millimeters in diameter, wherein the generally conical shaped protrusion tapers to a tip that is less than 9 millimeters in diameter. In some embodiments, the object may be an improvised tool. Many common objects such as screw drivers, ball point pens, headphone plugs, to name just a few non-limiting examples, may be improvised tools.

The release passage 1121 and insert release 1101 may also provide a through passage 1103 for allowing moisture or debris to escape from the magazine assembly 100 without disassembly, allowing for a greater interval between cleanings in the field.

It should be noted that in some embodiments, the follower 108, the insert 110, and the floorplate 112 may be substantially made of a polymeric material. In some embodiments, the release passage 1121 may be substantially made of a resilient material, and/or of a color that contrasts with the magazine housing 102 to improve visibility.

Figure 6:
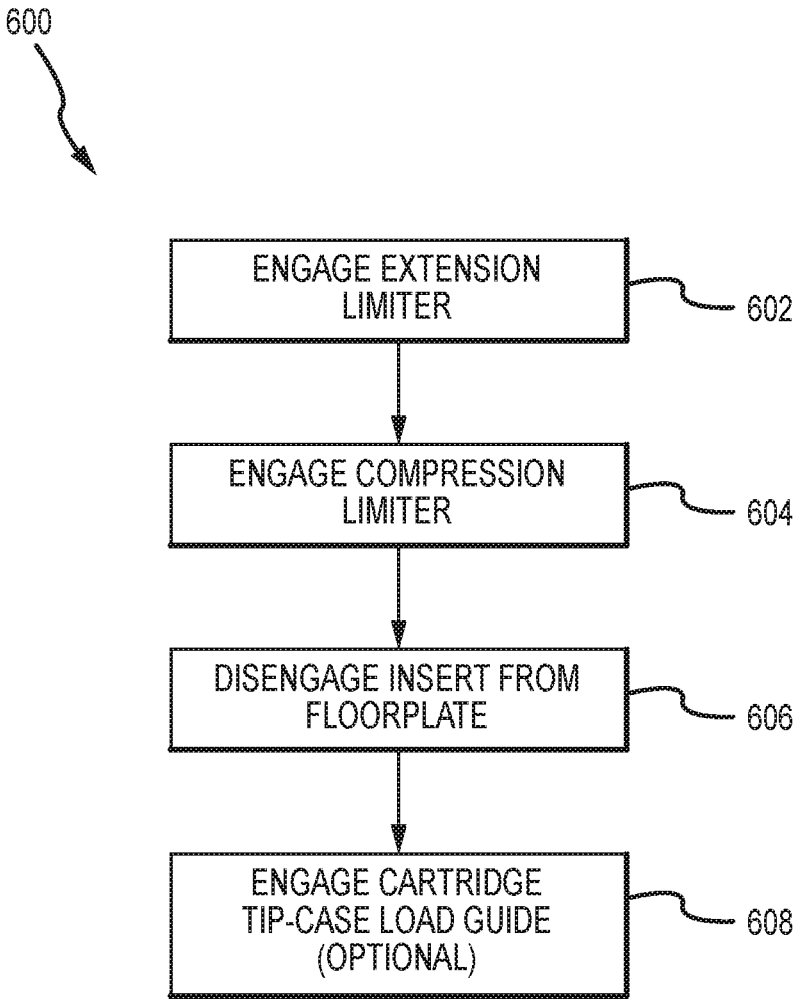
FIG. 6 is a flow diagram of a method according to some embodiments.

Turning now to FIG. 6, a method 600 of using a firearm magazine assembly is now discussed. The method 600 may be practiced on a firearm magazine assembly such as that previously described with reference to FIGS. 1-5. The method 600 includes engaging an extension limiter 602, engaging a compression limiter 604, and disengaging an insert from a floorplate 606. The method 600 may further include engaging a cartridge loading guide 608.

Engaging an extension limiter 602 is performed to prevent a spring from forcing the follower against the feed lips when the magazine is empty, while engaging a compression limiter 604 is performed to prevent a spring in the follower assembly from over-compression.

Engaging an extension limiter 602 may include allowing a plurality of tabs in the follower to engage one or more shelves in the housing to prevent the spring from forcing cartridge follower against the feed lips. Engaging an extension limiter 602 may further include biasing or pulling the housing towards the follower when the follower assembly is in an extended configuration.

In some embodiments, engaging a compression limiter 604 includes causing one or more protrusions extending from a proximal side of the follower to abut the insert to prevent over-compression of the spring. In other embodiments, engaging a compression limiter includes causing one or more protrusions extending from a distal side of the insert to abut a proximal side of the follower to prevent over-compression of the spring.

Disengaging 606 the insert from the floorplate may include disengaging the insert from the floorplate using a 9 mm cartridge or an improvised tool.

Engaging a cartridge loading guide 608 while loading a cartridge may further include aligning a rim of the cartridge being loaded with a case of a previously-loaded cartridge.

The method 600 may further include loading 9 mm cartridges into the magazine.

Embodiments of the invention can be embodied in a variety of ways. In addition, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. As but one example, it should be understood that all action may be expressed as a means for taking that action or as an element which causes that action. Similarly, each physical element disclosed should be understood to encompass a disclosure of the action which that physical element facilitates. Regarding this last aspect, the disclosure of a "release mechanism" should be understood to encompass disclosure of the act of "releasing"—whether explicitly discussed or not—and, conversely, were there only disclosure of the act of "releasing", such a disclosure should be understood to encompass disclosure of a "release mechanism". Such changes and alternative terms are to be understood to be explicitly included in the description.

In conclusion, the present invention provides, among other things, a system and method for using a firearm magazine assembly. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A firearm magazine assembly, comprising:

a housing defining a cartridge track, the housing having a distal end comprising feed lips for feeding cartridges to a firearm and a proximal end; and a follower assembly comprising a follower and a spring, the follower having a proximal side and a distal side and movable between a compressed position and an extended position, the follower further having at least two angled surfaces configured to engage the housing and bias the feed lips towards each other when the follower is in the extended position.

2. The magazine assembly of claim 1, wherein:

the at least two angled surfaces are configured to engage one or more shelves in the housing when the follower is in the extended position to prevent the spring from forcing the follower against the feed lips.

3. The magazine assembly of claim 2, wherein:

the at least two angled surfaces are shaped to pull the housing towards the follower when the at least two angled surfaces engage the one or more shelves in the housing.

4. The magazine assembly of claim 2; wherein:

the at least two angled surfaces are each angled relative to a follower horizontal.

5. The magazine assembly of claim 4, wherein:

the follower comprises a pitch axis, a yaw axis, and a roll axis;

at least one of the at least two angled surfaces is parallel to a first plane, the first plane crossing a single point on the pitch axis of the follower and two points on the roll axis of the follower; and at least one of the at least two angled surfaces is parallel to a second plane, the second plane crossing a single point on the roll axis of the follower and two points on the pitch axis of the follower.

6. The magazine assembly of claim 5, wherein:

a first of the at least two angled surfaces is parallel to the first plane;

a second of the at least two angled surfaces is parallel to a third plane, the third plane crossing a single point on the pitch axis of the follower and two points on the roll axis of the follower; and the first and the second of the at least two angled surfaces are on opposing sides of the follower.

7. The magazine assembly of claim 1, wherein:

the magazine assembly further comprises a floorplate removably engaged with the proximal end of the housing, and an insert comprising an insert release; wherein the floorplate comprises a release passage;

the insert release comprises a resilient material, and is shaped to interference fit an interior portion of the insert; and the insert release and the release passage are shaped to enable disengagement of the insert from the floorplate using a 9×19 mm Parabellum cartridge.

8. The magazine assembly of claim 1, wherein:

the magazine assembly further comprises a floorplate removably engaged with the proximal end of the housing, and an insert;

the insert comprises an insert release; and the floorplate comprises a release passage; and wherein the insert release comprises a resilient material, and is shaped to interference fit an interior portion of the insert; and the insert release and the release passage are shaped to enable disengagement of the insert from the floorplate using one of a 9×19 mm Parabellum cartridge, a similarly blunt-nosed cartridge, or a similarly blunt-nosed improvised tool.

9. The magazine assembly of claim 8, wherein:

the insert release is substantially made of a resilient material.

10. The magazine assembly of claim 1, wherein:

the distal end of the housing comprises a cartridge loading guide configured to align a rim of a cartridge being loaded to with a case of a previously-loaded cartridge.

11. The magazine assembly of claim 1, wherein:

the magazine assembly is configured to feed one of:

9×19 mm Parabellum cartridges, similarly blunt-nosed pistol cartridges, or similarly blunt-nosed cartridges.

12. The magazine assembly of claim 1, wherein:

the housing comprises a relief for allowing a trigger bar to function when the magazine assembly is installed in a weapon.

13. The magazine assembly of claim 1, wherein:

the feed lips are made of a polymeric material.

14. A method of using a firearm magazine assembly, the firearm magazine assembly comprising a housing and a follower assembly, the housing defining a cartridge track, the housing having a distal end comprising feed lips for feeding cartridges to a firearm and a proximal end, the follower assembly comprising a follower and a spring, the follower having a proximal side and a distal side and movable between a compressed position and an extended position, the method comprising:

causing the follower to engage the housing when the follower is in the extended position; and causing the follower to bias the feed lips of the housing towards each other when the follower is in the extended position.

15. The method of claim 14, further comprising:

allowing at least two angled surfaces in the follower to engage one or more shelves in the housing to preclude the spring from forcing a loaded cartridge against the feed lips.

16. The method of claim 15, wherein:

at least one of the at least two angled surfaces in the follower is defined by a distinct plane that is neither parallel nor perpendicular to a horizontal of the follower.

17. The method of claim 14, further comprising:

causing the follower to engage the housing to pull the housing towards the follower when the follower assembly is in the extended position.

18. The method of claim 14, wherein the firearm magazine assembly comprises a floorplate removably engaged with a proximal end of the housing, and an insert comprising an insert release; the method further comprising:

disengaging the insert from the floorplate using a 9×19 mm Parabellum cartridge, a similarly blunt-nosed improvised too, or a similarly blunt-nosed cartridge.

19. The method of claim 14, wherein the firearm magazine assembly comprises a floorplate removably engaged with a proximal end of the housing, and an insert comprising an insert release; the method further comprising:

disengaging the insert from the floorplate using a blunt-nosed improvised tool.

20. The method of claim 14, further comprising:

engaging a cartridge loading guide of the housing while loading a cartridge to align a rim of the cartridge being loaded with a case of a previously-loaded cartridge.

21. The method of claim 14, wherein:

the feed lips of the housing are made of a polymeric material.

* * * * *